United States Patent [19]

Kohler

[11] Patent Number: 4,874,472

[45] Date of Patent: Oct. 17, 1989

[54] DRY CLEANING EQUIPMENT UTILIZING PERCHLORETHYLENE RECOVERY PROCESS

[75] Inventor: Tilo Kohler, West Babylon, N.Y.

[73] Assignee: Richard L. Miller, Dix Hills, N.Y.

[21] Appl. No.: 260,114

[22] Filed: Oct. 20, 1988

Related U.S. Application Data

[62] Division of Ser. No. 857, Jan. 6, 1987, Pat. No. 4,780,218.

[51] Int. Cl.[4] ..... B01D 3/02

[52] U.S. Cl. ..... 202/169; 202/170; 210/180

[58] Field of Search ..... 62/12; 202/163–170; 8/142; 210/774, 175, 177, 178, 179–180, 181–183

[56] References Cited

U.S. PATENT DOCUMENTS 4,254,646 3/1981 Selesnick ..... 62/12

*Primary Examiner*—Frank Sever

*Attorney, Agent, or Firm*—Richard L. Miller

[57] ABSTRACT

A method for a perchlorethylene recovery process for dry cleaning equipment in which virtually all of the perchorethylene is recovered from the process so as to increase the economic efficiency of the system while at the same time reducing the hazardous to both environment and the operator's health.

1 Claim, 1 Drawing Sheet

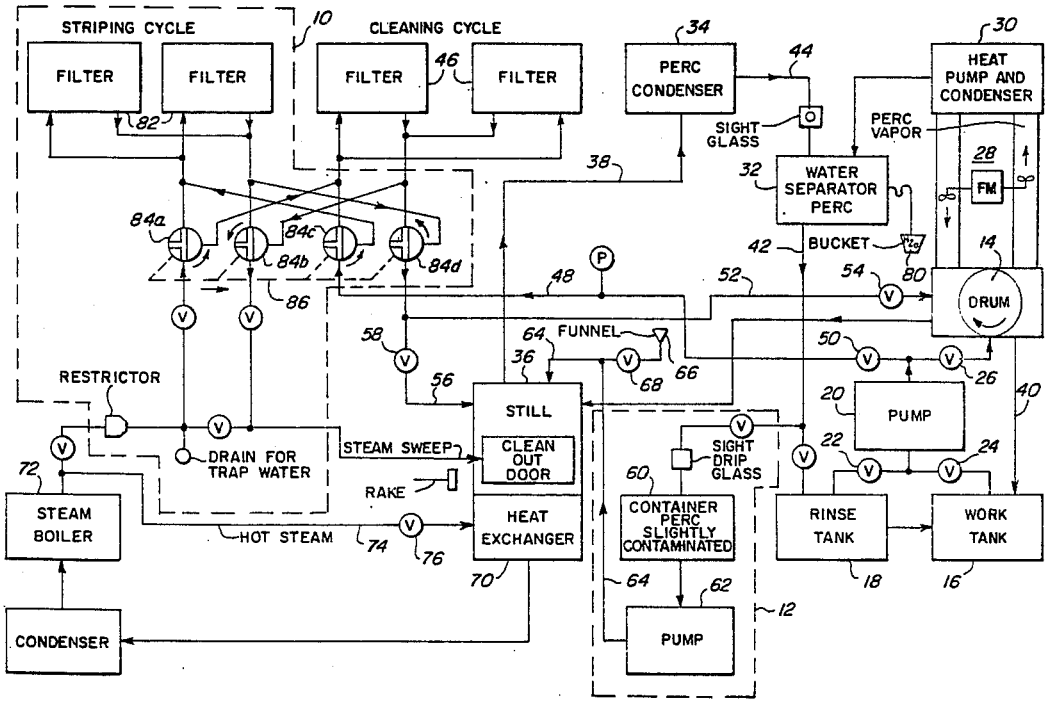

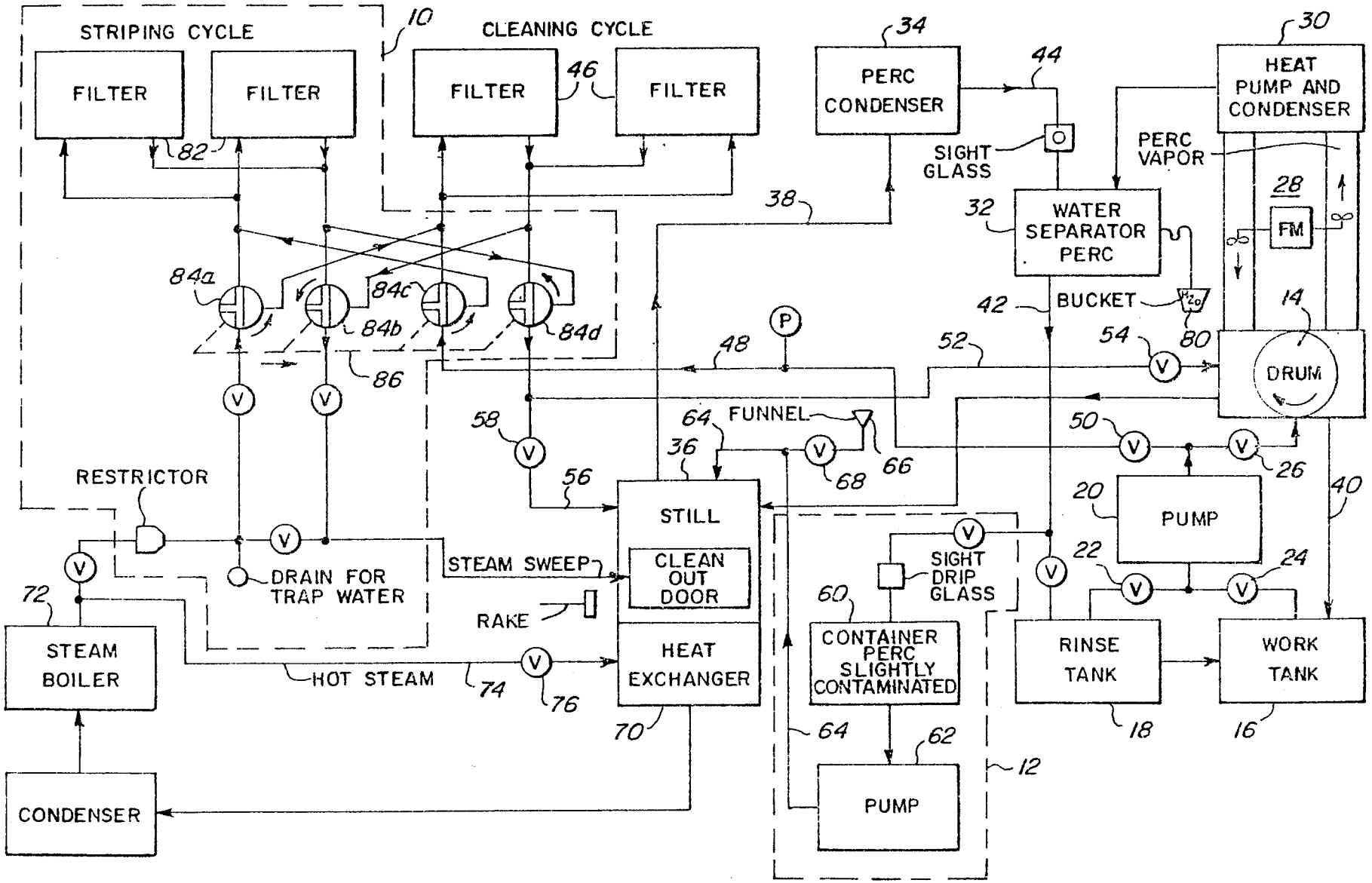
HEAT PUMP AND CONDENSER
30
28
FM
14
DRUM
40
WORK TANK
16
26
24
PUMP
20
22
RINSE TANK
18
PERC VAPOR
WATER SEPARATOR PERC
32
BUCKET
80
54
50
44
SIGHT GLASS
42
52
12
SIGHT DRIP GLASS
CONTAINER PERC SLIGHTLY CONTAMINATED
60
62
PUMP
64
PERC CONDENSER
34
66
68
FUNNEL
38
P
48
64
36
STILL
CLEAN OUT DOOR
HEAT EXCHANGER
70
CLEANING CYCLE
FILTER
46
FILTER
84d
56
58
STEAM SWEEP
RAKE
76
74
10
84c
84b
86
DRAIN FOR TRAP WATER
HOT STEAM
STRIPING CYCLE
FILTER
FILTER
82
84a
RESTRICTOR
72
STEAM BOILER
CONDENSER

DRY CLEANING EQUIPMENT UTILIZING PERCHLORETHYLENE RECOVERY PROCESS

This application is a divisional application of Ser. No. 07/000,857, filed on Jan. 06, 1987, to issue to U.S. Pat. No. 4,780,218, on Oct. 25, 1988, and for which there has been maintained a continuous chain of copendency.

BACKGROUND OF THE INVENTION

The instant invention relates generally to the perchlorethylene recovery process for dry cleaning equipment, and more specifically on an improvement in both conventional equipment and the method for the dry cleaning of fabric. The instant invention to be described is more efficient and recovers a larger percentage of perchlorethylene dry cleaning fluid (which hereinafter will be referred to sometimes as perc in this application).

Numerous dry cleaning systems with solvent recovery have been provided in the prior art that are adapted to recover their cleaning solvent. For example, U.S. Pat. Nos. 3,738,074 to Victor, 3,775,053 to Wisdom, and 4,086,706 to Wehr all are illustrative of such prior art. While these units may be suitable for the particular purpose to which they address, they are not the same, and are not be suitable for the purpose of the present instant invention as hereafter described.

SUMMARY OF THE INVENTION

A primary object of the present invention is to provide a perchlorethylene recovery process for dry cleaning equipment that will overcome the shortcomings of the prior art devices.

Another object is to provide a perchlorethylene recovery process for dry cleaning equipment in which virtually all of the perc is recovered from the process.

An additional object is to provide a perchlorethylene recovery process for dry cleaning equipment in which the operator does not breath nor is exposed to perc fumes or even other wise exposed to the perc in almost any way.

A further object is to provide a perchlorethylene recovery process for dry cleaning equipment which eliminates all odors from the fabric being cleaned and does not compromise but rather enhances the quality of the cleaning process and the degree to of cleanliness of the fabric.

A yet further object is to provide a perchlorethylene recovery process for dry cleaning equipment in which the normal dry cleaning filtering cartridges are left so entirely free of perc that these cartridges can be discarded with regular trash without any health to the general public at large etcetera.

A yet still further object is to provide a perchlorethylene recovery process for dry cleaning equipment which utilizes a same steam sweep system for stripping both the still and filtering cartridges.

Yet still further additional object is to provide a perchlorethylene recovery process for dry cleaning equipment which typically improves the ratio of perc to fabric cleaned from typically 20,000 lbs of fabric to about 70,000 lbs of fabric per 50 gallon drum of perc.

Yet another object is to provide a perchlorethylene recovery process for dry cleaning equipment that is simple and easy to use for those skilled in the art.

A still additional further object is to provide a perchlorethylene recovery process for dry cleaning equipment that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figure in the drawing is briefly described as follows:

The figure is a block diagram of a typical dry cleaning fabric processing system with the added components to improve the process shown enclosed in dotted lines.

DETAILED DESCRIPTION OF THE PREFERRED EMBODIMENTS

In order that the instant invention be more clearly understood a description of parts of the conventional portion of the process will be explained but as a precursor to the understanding of the instant invention, and before examining the instant invention it is desirable to review what is involved in the ordinary dry cleaning cycle.

To start with the objective is to separate the dirt from the the fabric textiles and or garments to be cleaned. To do this the fabric or clothes are tumbled in the dry cleaning solvent perc much in the same way that clothes are washed in a conventional washing machine. However perc is a relatively expensive commodity, and is injurious to both the environment and the health of the operator. It is therefore desirable to reclaim or recycle as much dirty contaminated perc as possible and keep it as a permanent working fluid within the dry cleaning processing system and equipment for use over and over again and again.

To re-process the dirty contaminated perc there are several processes which are performed in a conventional system and generally in the following order:

1. Water is separated from the perc;
2. The perc is distilled; and
3. The perc is filtered in a cartridge.

The system conventionally includes the required valves, sight glasses, pumps, etcetera so that perc in various stages of cleanliness can be diverted back into the cleaning cycle as may be reasonably required at a particular point in a cycle. For example it would be very poor economy to use absolutely clean perc to begin or even continue a cycle wherein the cloth or fabric were quite dirty. Conventionally clean perc would most likely be saved for final rinses.

However there are two places in the perc reclaiming process in which perc is not salvaged in the conventional scheme of the cycle, which are as follows:

1. It seems that after the perc has been recycle several times there is a small amount of perc (approximately 1 lb.) which must be discarded from the water separator, or else the fabric or clothes take on an unpleasant odor.

2. When the filter cartridges are to be discarded because they are completely spent and can not accept any more contaminate there is always a certain amount of perc (approximately 2 lbs.) left in each cartridge at the time the cartridge is discarded.

It is at these two points in the cycle wherein the instant invention corrects the situation and recovers entirely the perc which is otherwise lost in the conventional dry cleaning process and equipment.

Having thus described substantially the nature of the of the loss involved in reclaiming perc in a conventional system a more detailed description of the instant invention will follow.

Turning now descriptively to the drawing is seen a figure which represents a block diagram of a typical dry cleaning process system with the addition of extra components enclosed in dotted contours 10 and 12 so as to create the more efficient perchlorethylene recovery process of the instant invention.

A conventional rotating drum tumbling mechanism 14 is shown in which fabric quite often which is in the form of conventional street clothes or other dry good which might be around a house of the general public, is present and available for the operator to place such items which are to be cleaned. Dry cleaning solvent fluid perc may be caused to be transferred into the drum 14 by pump 20, and valve set 22, 24, & 26, from work tank 16, or rinse tank 18 as may be required at a particular point in a cleaning cycle.

A circulated portion of the volatile fluids (water, perc & air) may be removed from the cycle by fan motor and duct assembly 28 to heat pump and condenser 30, some of which is caused to flow into a water separator 32, where it is freed from water and allowed to flow back to rinse tank 18 via path 42, along with clean perc from condenser 34. At a point in the cycle when the perc is too contaminated to be used for cleaning purposes, it is caused to flow into still 36 so that it can be returned to the cleaning cycle via paths 38, 44 and condenser 34 previously mentioned. Perc which is some what contaminated but is still useable for cleaning may be returned to work tank via path 40.

Perc which is contaminated to such a sufficient degree may be pumped directly to filter cartridges 46, via path 48, valve 50, and pump 20 previously mentioned, and then returned either directly to the drum 14 via path 52, and valve 54, or to still 36 via path 56, and valve 58 as a particular cleaning cycle may require.

After perc has been recycle several times that is so many gallons per so many kilo pounds of clothes cleaned separator 32 is drained of perc which is collected in container 60, but instead of discarding as is normally done in a conventional dry cleaning system this slightly contaminated perc is returned to still 36 either by a optional pump 62 via path 64, or by physically taking container 60 and dumping the contents therein into funnel 66, while opening valve 68. In any case the important consideration is that the perc is returned to the system at a point where it will be distilled again by still 36.

Because the conventional operation of the still component 36 has not been discussed it is appropriate to do so at this point in the examination of the scheme of things.

Normally contaminated perc enters the still 36 from path 56, and in the instant invention also from path 64, and is boiled of to a high degree in a conventional manner by heat supplied by hot steam from boiler 721, to heat exchanger 70. The boiled off perc leaves the still 36 and is returned to the cleaning cycle via path 38 as previously described. At some point in this portion of the perc reclaiming cycle the still will become sufficiently loaded with muck/high concentrated contaminate and perc mixed together wherein the concentration of muck is so high that the distillation process is no longer effective or efficient.

In order to efficiently reclaim the perc from this highly contaminated state live steam is normally allowed to enter the still 36 via path 74 and valve 76, dissolve and mix with the perc and re-condense in perc condenser 34, while excessive water is dumped in sewer or bucket 80. This portion of the process is commonly referred to in the art as sweeping the still and must be regularly carry out by the operator of the system.

When the filtering cartridges are determined to be filled to capacity with contaminate so as to longer be useful in the conventional system they are removed, discarded, and replaced with fresh cartridges. It is to be noted that every time the cartridges are replaced a significant amount of perc remains left in each cartridge, and is there by lost from the system. It might also be noted that there are laws which require that these cartridges be returned to a depot where they may be correctly and properly disposed of so as to not damage the environment or be so hazardous to the operator's health.

A feature of the instant invention is that the same steam that is used to sweep the still 36, on particular occasions when it is required to discard a set of filter cartridges 82 or 46, can be first diverted to flow through a set of filter cartridges 82 or 46 and then to the still 36. What occurs is that the live steam dissolves and mixes with all of the perc which would otherwise remain in a discarded filter cartridge and transfers this otherwise lost perc back into the still sweep reclamation cycle previously described, leaving the spent cartridges 82 or 46 as the case might be completely stripped and void of any measurable amount of perc whatsoever, and all without even any hint of extra cost in operating this system. An optional steam restricting element 88 appears to make both stripping process more efficient.

A set of valves 84*a*, 84*b*, 84*c* & 84*d* are ganged together by linkage 86 so that two separate set of filter cartridges 82 and 46 may be kept connected to the system so that a fresh set may be immediately switched into a cleaning cycle while a spent set is being stripped of any perc.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. In a dry cleaning apparatus using perchlorethylene as a cleaning solvent, said apparatus including a drum for tumbling the fabric to be cleaned together with said solvent, a still for receiving contaminated solvent after use in said drum, a source of steam, means for feeding said steam into said still for sweeping the still and dissolving the contaminates from said solvent, a condenser for receiving said mixture of solvent and steam an condensing said mixture, a water separator receiving the condensed mixture from said condenser and removing condensed water from said mixture leaving solvent from which contaminants have been removed, and a storage tank for holding said condensed solvent with a conduit passing the decontaminated solvent from said water separator to said storage tank whereby the solvent in the storage tank can be used again in the drum, the improvement which comprises:

means for enabling transfer of substantially all of said contaminated solvent from said drum to said still, including, (a) means connected with said conduit for diverting said solvent into a holding container at selected intervals during operation of said dry cleaning apparatus, and (b) pump means for passing said solvent from said holding container into said still for further decontamination thereof, whereby a substantially higher amount of contaminated solvent is recovered and substantially less contaminated solvent is discarded.

* * * * *